US006574893B2

(12) United States Patent
Mizutani

(10) Patent No.: US 6,574,893 B2
(45) Date of Patent: Jun. 10, 2003

(54) METHOD AND SYSTEM FOR SUPPORTING CONSTRUCTION OF UNDERGROUND CONTINUOUS WALL AND EXCAVATOR THEREFOR

(75) Inventor: Motohiko Mizutani, Akashi (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 0 days.

(21) Appl. No.: 10/026,685

(22) Filed: Dec. 27, 2001

(65) Prior Publication Data

US 2002/0112381 A1 Aug. 22, 2002

(30) Foreign Application Priority Data

Dec. 28, 2000 (JP) ..... 2000-403080
Jun. 29, 2001 (JP) ..... 2001-199297

(51) Int. Cl.[7] ..... E02F 3/08

(52) U.S. Cl. ..... 37/462; 37/906; 37/352; 405/267

(58) Field of Search ..... 37/352, 353, 347, 37/348, 382, 189, 462, 465, 906; 405/267, 269, 275; 172/2; 701/50

(56) References Cited

U.S. PATENT DOCUMENTS

| | | | | | |
|---|---|---|---|---|---|
| 4,843,742 | A | * | 7/1989 | Camelleri | 37/360 |
| 5,112,161 | A | * | 5/1992 | Trevisani | 405/267 |
| 5,244,315 | A | * | 9/1993 | Kitanaka et al. | 405/267 |
| 5,257,471 | A | * | 11/1993 | Kitanaka | 37/353 |
| 5,311,683 | A | * | 5/1994 | Camilleri | 37/362 |
| 5,349,765 | A | * | 9/1994 | Kitanaka et al. | 37/356 |
| 5,561,923 | A | * | 10/1996 | Kitanaka | 37/352 |
| 6,139,225 | A | * | 10/2000 | Koike et al. | 405/267 |
| 6,381,882 | B1 | * | 5/2002 | Mizutani et al. | 37/462 |
| 6,470,607 | B1 | * | 10/2002 | Taki | 37/352 |

FOREIGN PATENT DOCUMENTS

| | | | |
|---|---|---|---|
| JP | 55-30039 | * | 3/1980 |
| JP | 57-71923 | * | 5/1982 |
| JP | 1-94116 | * | 4/1989 |
| JP | 1-94117 | * | 4/1989 |
| JP | 2000-160549 | | 6/2000 |
| JP | 2000-192500 | | 7/2000 |
| JP | 2000-297443 | | 10/2000 |
| JP | 2001-336146 | * | 12/2001 |
| JP | 2002-61169 | * | 2/2002 |
| JP | 2002-256547 | * | 9/2002 |

* cited by examiner

*Primary Examiner*—Victor Batson
(74) *Attorney, Agent, or Firm*—Oblon, Spivak, McClelland, Maier & Neustadt, P.C.

(57) ABSTRACT

The present invention provides a system for supporting construction of an underground continuous wall wherein a control server connected to each excavator through a network comprises a ground strength evaluating unit for obtaining the ground strength distribution of the ground to be excavated in a depth direction on the basis of imparted ground property; a necessary excavating ability operating unit for obtaining the accumulated ground strength from said ground strength distribution, and obtaining necessary excavating ability of said cutter post balanced with the excavation resistant force obtained from said accumulated ground strength; a comparing unit for comparing the obtained said necessary excavating ability with the excavating ability of the excavator carried into a work site; an excavating efficiency evaluating unit for evaluating excavating efficiency on the basis of the comparison result of the comparing unit; and a transmit-receive unit for receiving a request from said excavator and transmitting the evaluation result of excavating efficiency by the excavating efficiency evaluating unit to the excavator, whereby enabling to provide necessary information corresponding to the condition of the ground and to carry out efficient construction work of a continuous wall.

16 Claims, 14 Drawing Sheets

FIG. 6

GROUND CONDITIONS

| | | |
|---|---|---|
| STANDARD PENETRATION TEST DEPTH DIRECTION SAMPLE NUMBER | 32 TIMES | C1 |
| UNDERGROUND WATER LEVEL | 3m | C2 |
| ..... | | |

CONSTRUCTION CONDITION/UNDERGROUND CONTINUOUS WALL CONSTRUCTION SPECIFICATION

| | | | | |
|---|---|---|---|---|
| CONSTRUCTION DEPTH | Ho | 32000 | mm | C3 |
| TANGENT SPEED | Vb | 69 | m/min | C4 |
| EXCAVATING WIDTH | Bo | 550 | mm | C5 |
| MODEL | | TRD 35 | | C6 |
| MAXIMUM TRAVERSE FORCE | Fp max | 55 | t | C7 |
| MAXIMUM TANGENT FORCE | Ft max | 37 | t | C8 |
| ..... | | | | |

FIG. 7

INPUT GROUND PROPERTY

C10

C9

C11

| KASAGRANDE SOIL PROPERTY SYMBOL | DEPTH | N VALUE |
|---|---|---|
| | m | time / 30cm |
| GF | 1.15 | 1 |
| ML | 2.15 | 1 |
| ML | 3.15 | 3 |
| SF | 4.15 | 12 |
| ML | 5.15 | 5 |
| ML | 6.15 | 4 |
| ML | 7.15 | 3 |
| MH | 8.15 | 2 |
| MH | 9.15 | 2 |
| MH | 10.15 | 1 |
| MH | 11.15 | 2 |
| CL | 12.15 | 4 |
| SW | 13.15 | 12 |
| GW | 14.15 | 200 |
| GW | 15.15 | 257 |
| GW | 16.15 | 100 |
| GW | 17.15 | 200 |
| GW | 18.15 | 100 |
| GW | 19.15 | 64 |
| GW | 20.15 | 19 |
| CL | 21.15 | 12 |
| CL | 22.15 | 15 |
| CL | 23.15 | 15 |
| CL | 24.15 | 17 |
| CL | 25.15 | 9 |
| CL | 26.15 | 32 |
| GW | 27.15 | 67 |
| GW | 28.15 | 75 |
| CL | 29.15 | 11 |
| CL | 30.15 | 11 |
| CL | 31.15 | 11 |
| CL | 32.15 | 11 |

EXCAVATING PERFORMANCE ESTIMATE

| | | |
|---|---|---|
| EVALUATION VALUE | 48 | C12 |
| ESTIMATE RESULT RELATIVE TO TEMPORARY ASSUMED TRAVERSE SPEED<br>CONTINUOUS TRAVERSE EXCAVATION ESTIMATE | ◎ | C13 |

METHOD AND SYSTEM FOR SUPPORTING CONSTRUCTION OF UNDERGROUND CONTINUOUS WALL AND EXCAVATOR THEREFOR

BACKGROUND OF THE INVENTION

1. Field of the Invention

The present invention relates to a method and a system for supporting construction when a continuous wall is formed in an underground, and an excavator therefor.

2. Description of the Related Art

The excavator for construction of an underground continuous wall comprises a traveling truck, and a cutter post hung down into the underground from the truck. Trenching is carried out while rotating a chain type cutter 52 using the cutter post as a guide.

The steps for the method for construction of underground continuous wall using the above excavator will be explained in order.

i) Step of Excavation

As shown by the dash-dotted contour line in FIG. 15*a*, a cutter 52 is placed into the excavated longitudinal trench. The traveling truck (not shown) is being moved in an excavating direction while rotating the cutter 52 to thereby excavate a continuous trench B1. Excavating liquid C is poured into the trench B1 in order to retain the shape of the trench B1.

ii) Step of Pouring Solidifying Liquid

As shown in FIG. 15*b*, the cutter 52 is returned to a starting end of the excavation while pouring ground solidifying liquid D into the trench B1. The ground solidifying liquid D and the excavating liquid C are stirred and mixed making use of the rotation of the cutter 52.

iii) Step of Re-stirring and Mixing

As shown in FIG. 15*c*, the cutter 52 is moved to an ending side of the excavation while rotating the cutter. Thereby, the ground solidifying liquid D and the excavating liquid C are further stirred and mixed. Thereafter, when soil cement which is a mixture of both the liquids C, D and the earth and sand resulting from excavation is solidified, a soil cement wall E is formed.

iv) Step of Next Excavation

As shown in FIG. 15*d*, a new trench B2 is excavated from the end of the formed soil cement wall E. The continuous soil cement wall E is formed by repeating the above-described steps.

However, the construction know-how has not been established yet, and the ground different in properties in the depth direction is excavated, which poses a problem that the construction predication is hard to establish.

Whether or not the construction of the underground continuous wall progresses as scheduled often depends upon the ground conditions. How to operate the excavator according to the ground conditions depends on the experiences of a field worker and the know-how, and if mistake is made on the judgment, the term of works is delayed.

In case the construction depth is deeper, the cutter post is left within the excavated trench even the excavating construction in that day has been completed. Further, unless the cutter post is in the state that the edge is fully cut with respect to the end of the soil to be excavated, there occur troubles such that at the start of operation, the cutter post flexes and is broken.

On the other hand, aging work is carried out when the construction of excavation is completed. The object thereof is to move the cutter post away from the soil, to remove a bend of the cutter post in advance, and to leave the cutter post at a position of pouring ground solidifying liquid, that is, a position sufficiently away from the land-making end.

The aging work and the friction cutting work are also carried out, in the present condition, on the basis of the experiences of an operator, and carrying out excavation efficiently is a most difficult task.

SUMMARY OF THE INVENTION

It is an object of the present invention to provide a method for supporting excavating construction for supporting so as to carry out construction of an underground continuous wall as scheduled, an excavator used therefor, and a construction supporting system.

The excavation supporting method according to the present invention carries out, in the construction of underground continuous wall carried out by inserting an excavating member into a cutter post, and moving the cutter post in a lateral direction while operating the excavating member to thereby form an excavated trench, supporting by the following procedures.

The distribution of ground strength of the ground to be excavated is obtained in a direction of depth. The accumulated ground strength is obtained from the distribution of ground strength. The necessary excavating ability of the cutter post balanced with the excavating resistance obtained from the accumulated ground strength is obtained. The thus obtained necessary excavating ability is compared with the excavating ability of the excavator used in the work site, and the excavating efficiency is evaluated on the basis of the compared result.

For example, the strength distribution of the ground to be excavated is first obtained in the direction of depth on the basis of the property of ground obtained by drilling survey, and the accumulated ground strength is obtained from the strength distribution. The accumulated ground strength will be the ground resistance exerting on the cutter post at the time of excavation. When the excavating work is carried out, the necessary excavating ability of the cutter post balanced with the accumulated ground strength is calculated. As a result, the minimum excavating force as the minimum value of the excavating force that may compete with the accumulated ground strength is obtained. Accordingly, control may be made so as to have the excavating ability more than that mentioned above.

Comparing the necessary excavating ability with the excavating ability of the excavator carried into the work site, the fact that the ground to be excavated can be excavated by ability of what % of rated value can be evaluated. For example, in case of soft excavating ground, the evaluated value of the excavating ability is small. In this case, it is expected that the construction is carried out as scheduled.

Conversely, in case of hard excavating ground, the evaluated value is large. In this case, in order to be in time for the term of works, means may be employed in which the excavator is operated at the upper limit of ability, or the excavating ability is saved to extend the operating time.

Accordingly, since the excavating efficiency is evaluated as described above, it is possible to make an accurate excavating construction plan according to the ground to be excavated.

Further, carrying out of the aging work or the friction cutting work in the above construction is well suited.

BRIEF DESCRIPTION OF THE DRAWINGS

FIG. 6 is a schematic view showing the ground conditions and input cells displayed on the CRT screen;

FIG. 7 is a schematic view showing the input cells of ground property displayed on the CRT screen;

DESCRIPTION OF THE PREFERRED EMBODIMENTS

In the following, one embodiment of the construction supporting system of the underground continuous wall construction according to the present invention will be described with reference to the drawings. This is one embodiment of the present invention, and is not limited thereto.

Figure 1:
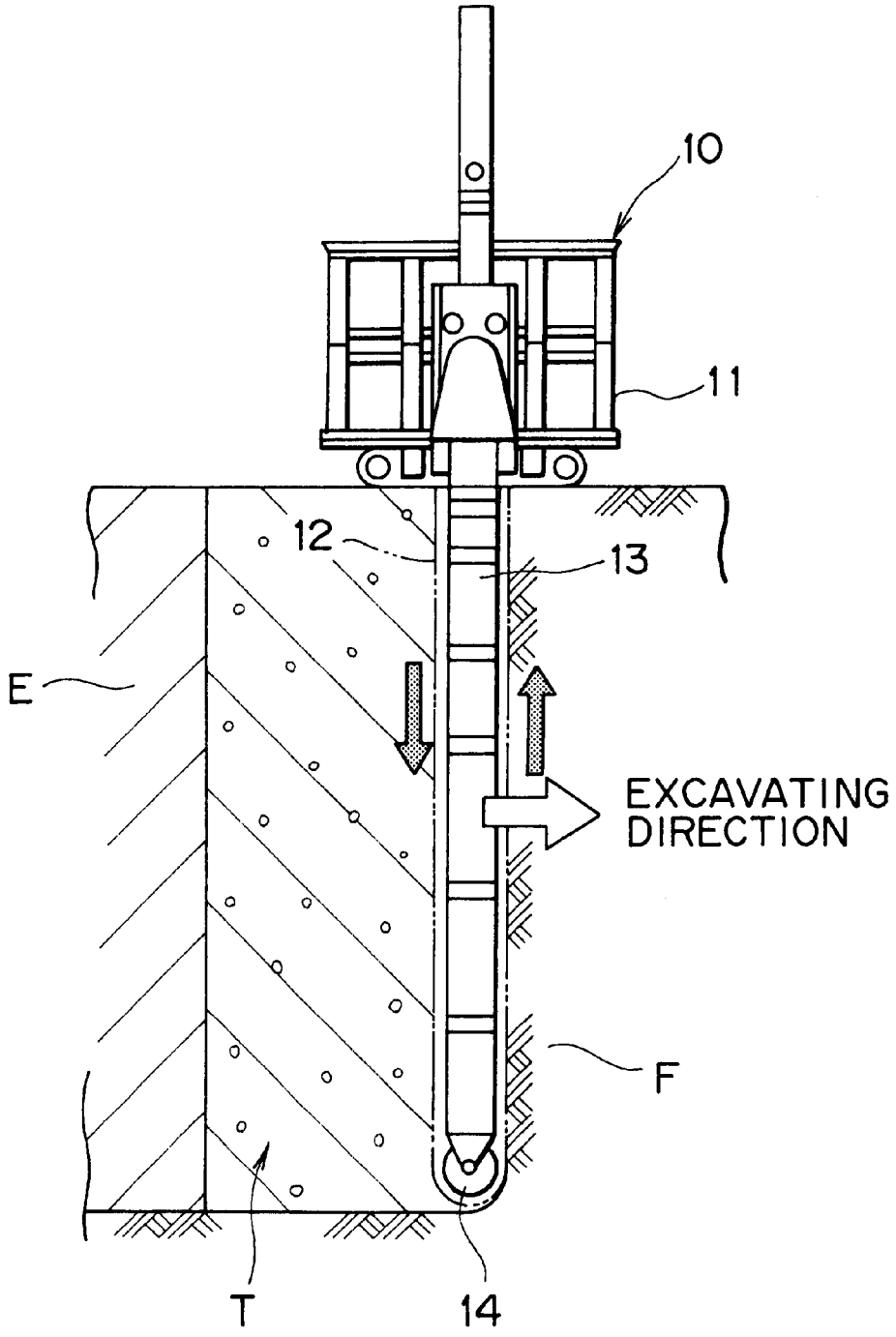
FIG. 1 is a schematic constituent view of an excavator used in a construction supporting system according to one embodiment of the present invention.

FIG. 1 shows an excavator 10 used in the construction method of an underground continuous wall. The excavator 10 mainly comprises of a base machine 11 as a traveling truck capable of moving on the surface of the earth, and a cutter post 13 hung down into the ground. Wound around the cutter post 13 is a chain type cutter 12 as an excavating tool (an excavator member) having a plurality of excavating bits. The base machine 11 is moved in the excavating direction as shown while moving the cutter 12 in the outer circumference of the cutter post 13. As a result, a trench T is excavated by pressing the end of the soil of the ground F.

At that time, by discharging excavating muddy water from a ground pouring agent discharge hole 14 provided at the lower end of the cutter post 13 under the fixed pressure to support excavation of the trench T, or by discharging ground solidifying liquid from the discharge hole and mixing and stirring it with excavated earth or the like, a soil cement wall E is formed.

In forming the excavated trench and the soil cement wall, any of main construction methods mentioned below are suitably selected according to the construction circumstances.

1) So-called one pass construction method for carrying out both of them continuously.

2) 2-pass construction method for forming the soil cement wall E along the trench T after excavation of the trench T has been completed.

3) 3-pass construction method for re-moving the cutter post 13 to the excavation starting position after the trench T has been completed to form the soil cement wall E along the formed trench T.

Figure 2:
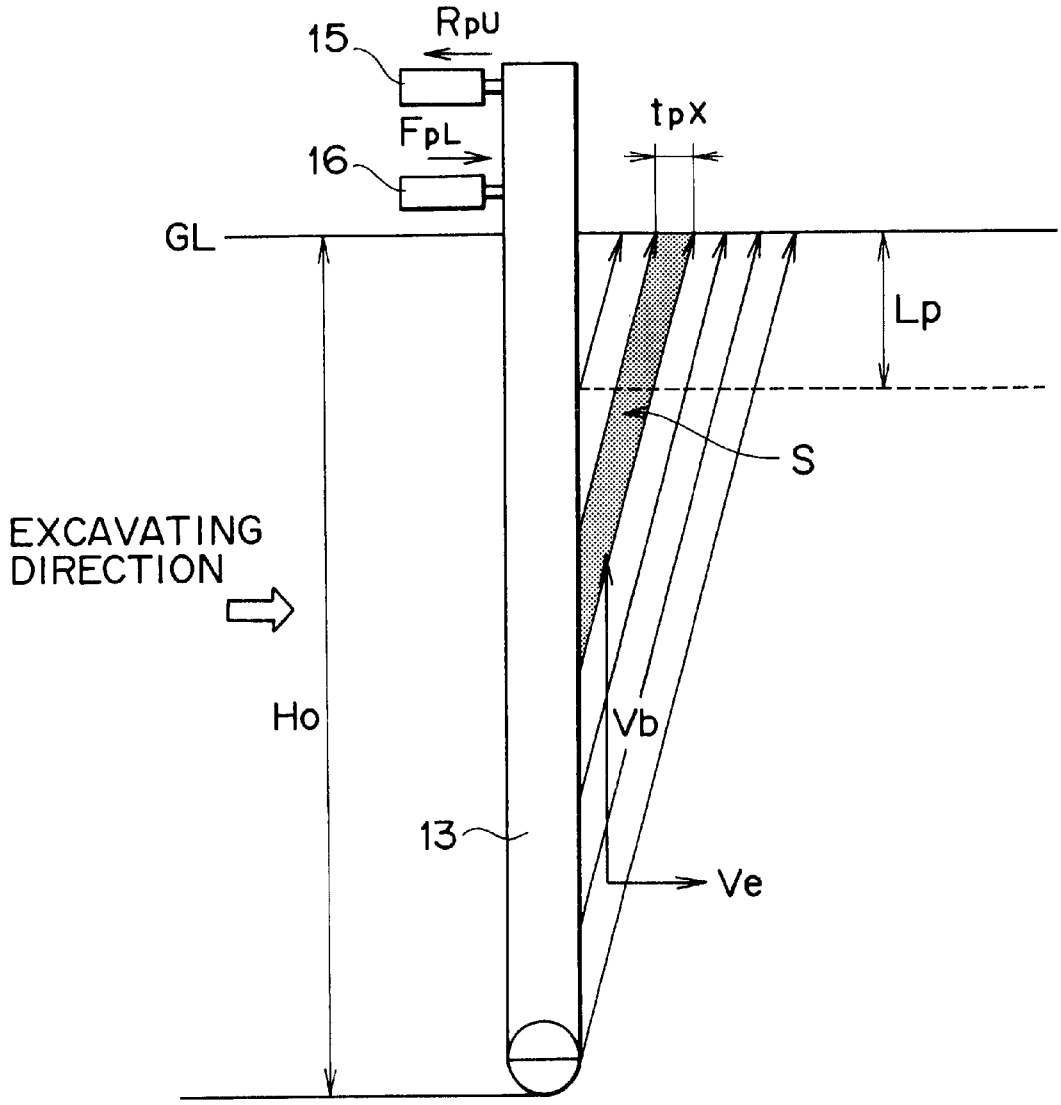
FIG. 2 is a schematic view of an excavating model of the excavator according to one embodiment of the present invention.

FIG. 2 shows an excavating model by way of the excavator 10. The excavator 10 causes the excavating bits of the chain type cutter to move in the substantially vertical direction while pressing horizontally the cutter post 13 inserted into the ground, and carries out excavation every one pattern in accordance with the principle of shaving by a planer.

At the upper parts of the cutter post 13, a transverse upper cylinder 15 and a transverse lower cylinder 16 are provided in parallel. The cutter post 13 can be pressed against the ground by thrust $F_{PL}$ of the transverse lower cylinder 16. However, the transverse upper cylinder 15 generates the cylinder holding force $R_{PU}$ in the direction opposite the pressing direction of the transverse lower cylinder 16.

The excavating ability of the excavator can be obtained from the maximum thrust of the transverse cylinders provided on the cutter post.

If the thrust $F_{PL}$ is short, the excavation transverse speed lowers to fail to excavate the ground. Further, the rated thrust $F_{PL}$ of the transverse lower cylinder 16 of the excavator 10 shown in the present embodiment is 55 t.

Here, let Vb be the tangent speed (mm/min), Ve be the excavating speed (mm/Hr), Lp be the overall section excavation 1 pattern length, and tpx be the cut depth (mm) per pattern. At this time, the relationship of Lp: tpx=Vb: Ve is established. Accordingly, the cut depth tpx is obtained from the following equation $$Tpx=(Ve/Vb)\times Lp \qquad \text{Equation (1)}$$

Actually, since the excavating speed is overwhelmingly small as compared with the tangent speed, the 1 pattern excavating volume S is thinner in width than that shown in FIG. 2, and its inclination is close to the vertical.

Figure 3:
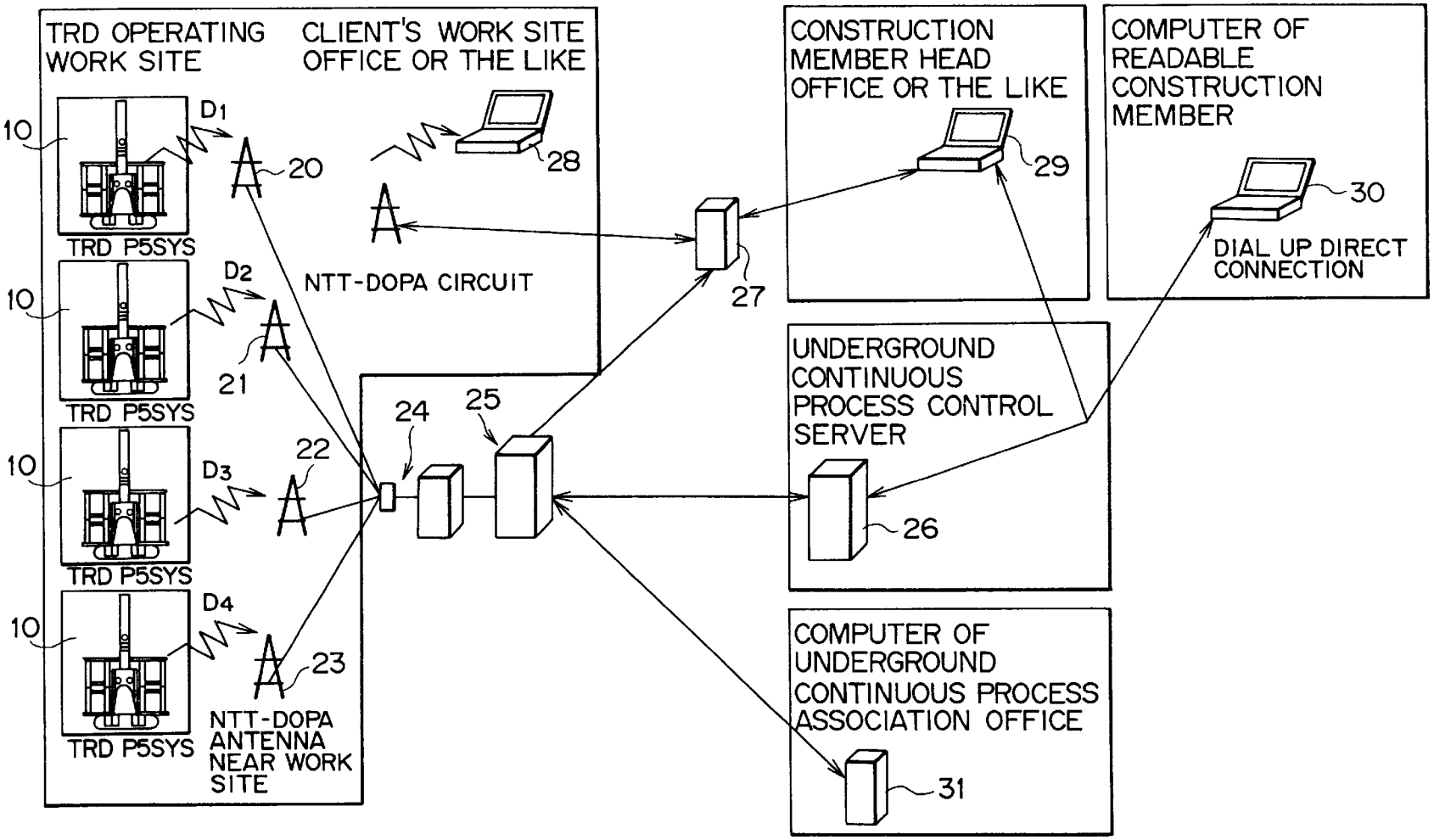
FIG. 3 is a whole constituent view of the construction supporting system according to one embodiment of the present invention.

FIG. 3 shows a construction supporting system of underground continuous wall having a plurality of excavators 10 having the above-described constitution connected by a network.

The supporting system according to the present invention is an underground continuous wall construction system in which a cutter post provided with an excavating member is inserted into the ground, and the cutter post is moved in a lateral direction while operating the excavating member to thereby form an excavated trench, wherein an excavator in each work site is connected to a control computer through a network, the control computer comprising a ground strength evaluating unit for obtaining the ground strength distribution of the ground to be excavated on the basis of the ground property given, a necessary excavating ability operation unit for obtaining the accumulated ground strength from the ground strength distribution, and obtaining the necessary excavating ability of the cutter post balanced with the excavating resistance obtained from the accumulated ground strength, a comparison unit for comparing the obtained necessary excavating ability with the excavating ability of the excavator carried in the work site, an excavating efficiency evaluation unit for evaluating the excavating efficiency on the basis of the compared result, and a transmit-receiving unit (a transceiver unit) for receiving a request from the excavator and transmitting the evaluated result of the excavating efficiency to the excavator.

In this case, if the ground conditions, the conditions regarding how to use an excavator, the construction conditions and the like are transmitted from the excavating work site connected to the control computer through the network to the control computer, the control computer is able to carry out the evaluation of the excavating efficiency in the work site and to transmit the evaluated results to the excavator.

Further, as the excavator used in the ground continuous wall construction system, an excavator used in the aging supporting method described later can be applied. Further, an excavator used in the friction cutting supporting method described later can be also applied. Furthermore, an excavator having both the constitution of the excavator used in the aging supporting method and the constitution of the excavator used in the friction cutting supporting method can be also applied.

Each excavator 10 in the excavating work site is provided with a wireless device to enable compressing and transmitting collected excavating work data, mechanical load data D1 to D4 and so on.

Figure 4:
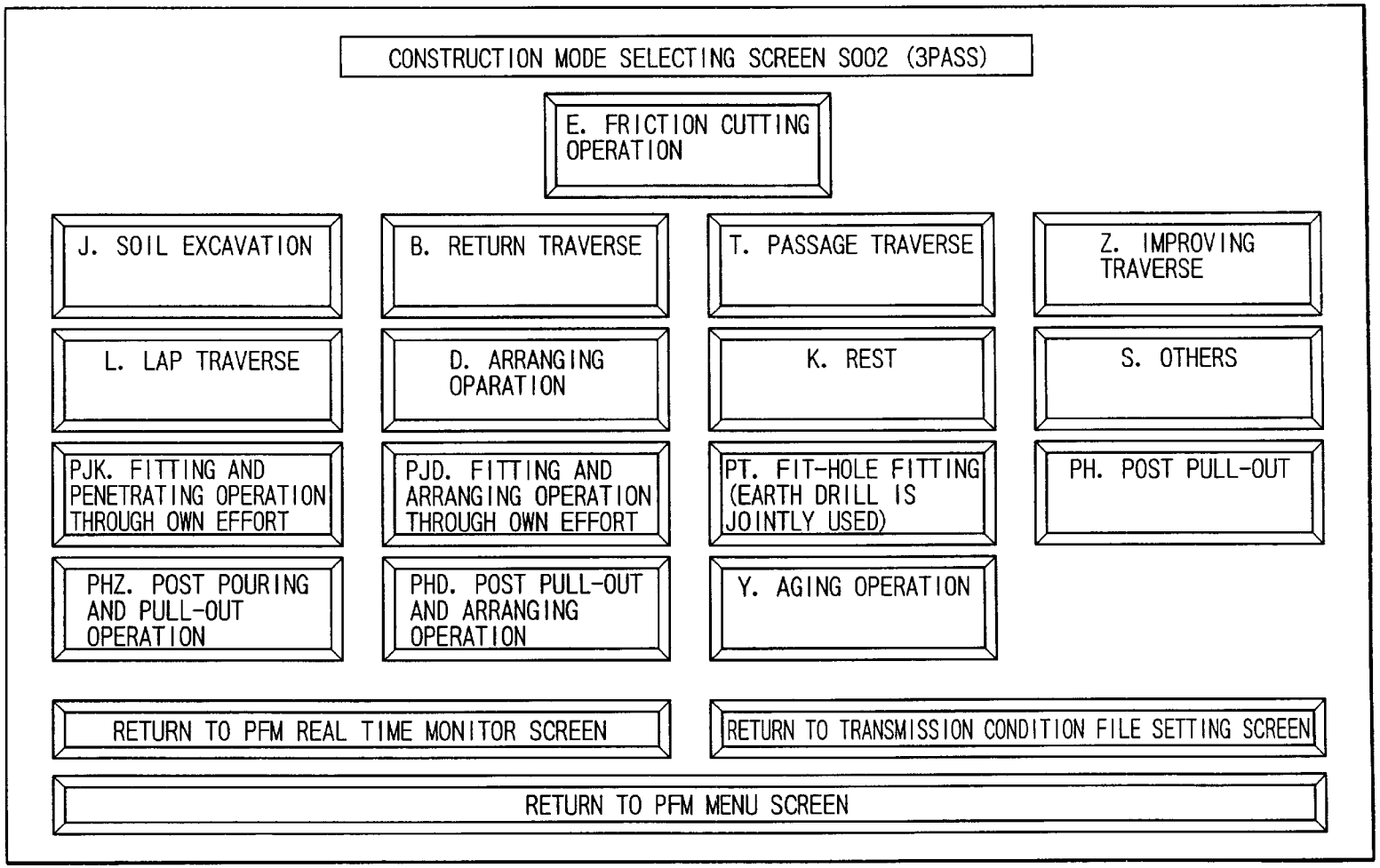
FIG. 4 is a schematic view showing an excavating mode selecting screen.

FIG. 4 shows an excavation/construction selecting screen. On the screen, for example, the soil excavating work (J) is selected. In this case, the work contents and work time are transmitted as excavating work data. Further, the passage of time and output change of an actuator in the excavator are transmitted as mechanical load data. These data are sent to an underground continuous wall construction control server as a control computer described later and formed into a graph for use of construction control.

The data transmitted from the excavator 10 are received by any of closest antennas 20 to 23 shown in FIG. 3. The data are sent, through a relay station 24, and through a public circuit, to a general provider 25 having a connection base with the relay station 24. Further the data are stored temporarily in a mail server of the provider 25.

This provider 25 is able to transmit and receive data of a separate provider 27 with which construction organizations, excavator makers or the like in which are joined construction companies having the same kind of excavators are under contract originally. For example, if one gets access from a computer 28 arranged in a work site office through the provider 27, copies of data temporarily stored in the provider 25 can be taken in. The taken-in data can be processed and edited originally by the work site.

Further, the provider 25 is connected to an underground continuous wall construction control server (hereinafter referred to as a control server or simply a server) 26. This control server 26 is able to draw out periodically data stored in the mail server of the provider 25.

Ground data obtained by the drilling survey carried out in advance in the construction site are sent from the terminal mounted on the computer 28 or the excavator 10 in the work site to the control server 26 through a cable for transmission or wireless. Others can be taken in the server 26 through portable recording media, for example, such as a floppy disk or CD-ROM.

Further, the ground strength in each depth can be converted from the test results obtained by soil property and standard penetration tests every depth obtained by a geological survey by way of drilling survey.

In this case, it is possible to calculate accurately the ground resistance exerting on the cutter post.

Further, a pressure sensor can be mounted on the traverse lower cylinder 16. Data of initial reaction detected by the pressure sensor are input into the terminal of the excavator 10 and stored sequentially, and converted into data of transfer type, after which they are transmitted through a wireless device. In this case, the ground data can be automatically transmitted to the control server 26 from the excavator 10.

The control server 26 can be accessed merely by construction members of underground continuous wall construction for which access is authorized by a password (for example, a computer 29 installed in the head office of the construction members, or a computer 30 of the construction members). Thereby, the latest information of the whole members can be read.

Numeral 31 designates a computer installed in the office of the society of underground continuous wall construction process. The computer 31 carries out maintenance of the control server 26 through the provider 25, sets correction of data accumulated or carries out setting several kinds of value to the server 26. Further, it can carry out correction of applications relating to the underground continuous wall construction with respect to the terminal of the excavator 10.

Figure 5:
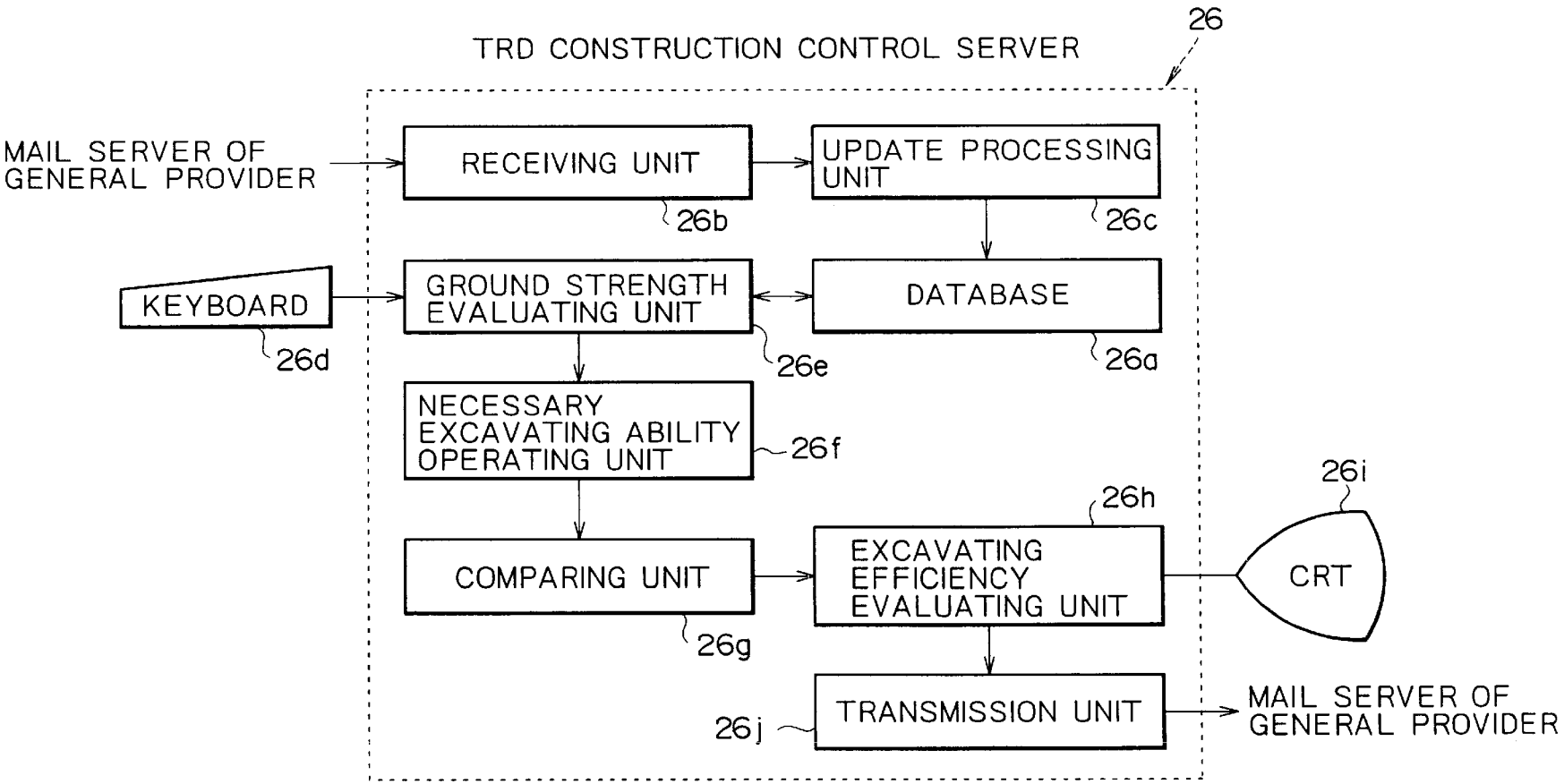
FIG. 5 is a block diagram showing the constitution of a control server of the construction of underground continuous wall.

FIG. 5 shows the basic constitution of the control server 26. The server 26 comprises a database 26*a* (hereinafter referred sometimes to as DB) for storing ground data, the excavating traverse actual results collected in the work site, and so on. The server 26 controls the access right to DB 26*a*.

Preferably, the server 26 as the control computer has a database for accumulating information such as ground properties tested in each work site, and is constituted so that on receipt of a request from the excavator, necessary information is transmitted.

In this case, because the ground information or the like transmitted from the excavators in the sites are accumulated in the database of the control server, the accuracy of evaluation can be enhanced when the excavating efficiency is evaluated.

In case the compressed data is taken in from the provider 25, whether or not the data is data of a pre-registered person is collated. When collation is completed, from which excavator the data was transmitted is identified. An updating processing unit 26*c* stores the ground data in DB 26*a* together with excavator identification information. In this manner, the ground data or the like transmitted from the sites are stored in DB 26*a* sequentially. It is noted that aging data and friction cutting data (described later) transmitted from the sites can be also stored in DB 26*a*.

As described above, the data being automatically transmitted from the excavators 10 during operation thereof are identified and stored in DB 26*a*. Thereby, data of various excavating circumstances and the like are automatically updated. Further, the obtained data are output in numerical value, a graph or the like on the screen of a CRT 26*i* as display means.

One can inquire of the server 26 about the evaluation of the excavating efficiency from the work site. The flow thereof will be schematically explained.

When inquiry about the evaluation of the excavating efficiency is made, a ground strength evaluation unit 26*e* first reads out ground data stored in DB 26*a* to prepare a ground strength distribution. Then, a necessary excavating ability operation unit (pressing force operation unit) 26*f* computes a horizontal pressing force of the cutter post 13 balanced with the ground strength, that is, thrust (necessary excavating ability) requested for the traverse lower cylinder 16. It is noted that in case the ground data of the excavating work site is not present in DB 26*a*, the ground data obtained by the drilling survey or the like in the excavating work site is once stored in DB 26*a*, after which the ground strength distribution is prepared.

The obtained thrust of the traverse lower cylinder 16 is compared with the rated output (maximum traverse force) of the excavator 10 by a comparison unit 26*g*. An excavating efficiency evaluation unit 26*h* evaluates the excavating efficiency on the basis of the compared results, and the evaluation result is displayed on the screen of the CRT 26*i*. Further, the evaluation result is transmitted to the provider 25 through a transmission unit 26*j*, and stored in the mail server. Accordingly, a person on each work site get access to the provider 25 to receive the evaluation of the excavating efficiency inquired. A keyboard 26*d* as input means is used when the ground data, the underground water level or the like is input.

In the following, evaluation processing of the excavating efficiency will be explained.

The excavating efficiency evaluation by the construction supporting system shown in the present embodiment is, in case ground data (such as ground property view, N value, and earth quality), types of excavators (for example, such as I type, II type and III type), and construction conditions (such as depth, and excavating width) are decided, to obtain thrust of the traverse lower cylinder 16 necessary for realizing the temporary traverse speed, for example, 100 mm/min and obtain the evaluation value as the ratio of thrust to rated output, thereby evaluating the excavating efficiency. If the excavating efficiency is evaluated on the basis of the ground conditions of the work site, the excavating construction plan along the schedule can be made.

Further, in the present embodiment, not only the excavating efficiency is evaluated, but also the collection of actual result data is carried out easily through a network. Moreover, ground data collected form the excavating sites are stored in DB 26*a*. Therefore, in the sites, the rich excavating work actual results can be down-loaded from the server 26 to make a minute construction plan.

Figures 8, 9:
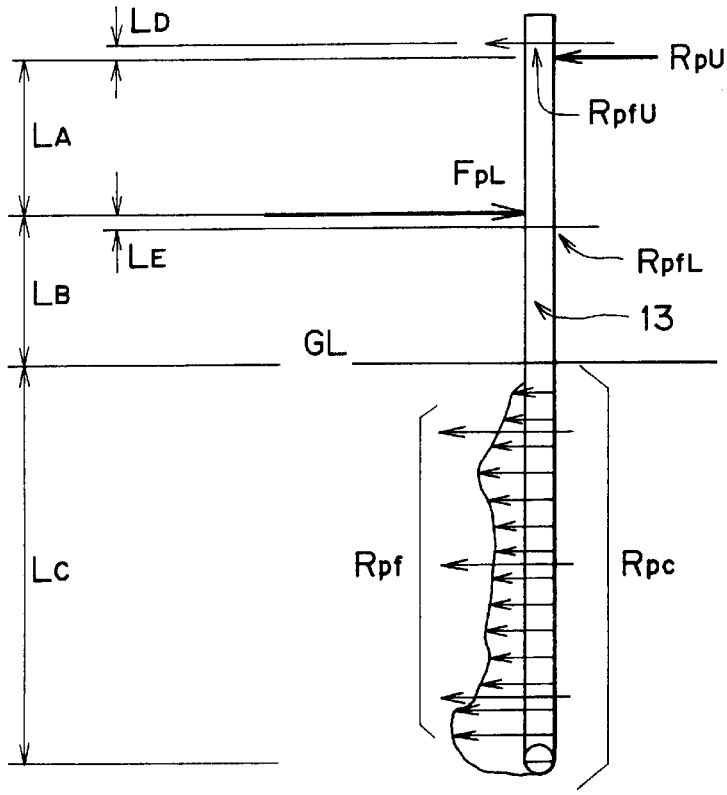
FIG. 8 is a schematic view showing an excavating model relating to the traverse force of an excavator.
FIG. 9 is a schematic view showing the estimated result of ground performance displayed on the CRT screen.

FIGS. 6, 7 and 9 show input columns displayed on the screen of the CRT 26*i*.

In FIG. 6, in the input cell of the ground conditions, there are prepared input columns comprising an input column C1 for inputting the depthwise sample number of the standard penetration test, and an input column C2 for inputting the underground water level.

Further, in connection with the input column of the construction conditions/underground continuous wall construction specification, there are prepared input columns such as a construction depth C3, a tangent speed C4, an excavating width C5, a model of machine C6, a maximum traverse force C7, and a maximum tangent force C8.

In FIG. 7, in the input cell of the ground property, there are prepared input cells such as an earth quality symbol C9, a depth C10, and an N value C11 as the test result of the standard penetration test. The ground property in that figure shows the results of measurement of depths from 1.15 m to 32.15 m with respect to the ground in a Takasago area of Hyogo-ken, Japan.

In FIG. 7, for example, "GF" shows fine grain-contained gravel, silty gravel, clayey gravel, and gravel of inferior clay distribution. "ML" shows silt (inorganic) and extremely fine sand, fine sand, rock powder, silty clay having a small plasticity, and lean clay. "GW" shows gravel of good grain size, a mixture of gravel and sand, showing that fine grains are a little or none.

Viewing the depthwise distribution of the N value, it is understood that the ground strength is particularly high in the range of depth from 14.15 to 18.15 m. These ground property data are stored in DB 26*a*.

When an inquiry about the excavating efficiency evaluation is made from the work site, the ground strength evaluating unit 26*e* converts the ground strength from N value every depth to compute the accumulated ground strength. The thrust of the traverse lower cylinder 16 balanced with the accumulated ground strength is obtained.

A thrust $F_{PL}$ generated by the traverse lower cylinder 16 is equal to the total of an excavation pressing resistance Rpc, a traverse friction resistances Rpf, traverse sliding friction resistances $R_{pfU}$, $R_{pfL}$ generated between a traversing leader portion, and a gate-shaped frame, and a cylinder holding force RpU of the traverse upper cylinder 15. That is, the thrust $F_{PL}$ is given by the following Equation (2).

$$F_{PL}=Rpc+Rpf+RpfU+RpfL+RpU \quad \text{Equation (2)}$$

Since the RpfU+RpfL can be ignored, the thrust $F_{PL}$ is given by the following Equation (3).

$$F_{PL}=Rpc+Rpf+RpU \quad \text{Equation (3)}$$

It is noted that RpU is obtained by measuring the thrust of the traverse upper cylinder 15.

The excavation pressing resistance Rpc can be derived theoretically from the assumed traverse speed. On the other hand, with the traverse friction resistance Rpf, the traverse friction force applied to each unit depth is computed assuming it constant.

Next, in the necessary excavating ability operation unit 26*f*, computation is made by replacing the balance between the thrust $F_{PL}$ and the accumulated ground strength with the balance of moment.

FIG. 8 shows an excavation model relating to the traverse force. In the figure, an arm reference position of moment is taken as a traverse upper cylinder position, that is, an acting point of the thrust RpU.

The counterclockwise moment M1 is generated by thrust $F_{PL}$ of the traverse lower cylinder 16, and given by $F_{PL}\times L_A$. On the other hand, the clockwise moment M2 is given by Rpc×Lx+Rpf×Lx.

The moment length is Lx because both Rpc and Rpf are the distribution load, respectively. Accordingly, in obtaining the thrust $F_{PL}$ of the traverse lower cylinder corresponding to the distribution load, moments in depths are accumulated, and the thrust of the corresponding traverse lower cylinder 16 is computed by a balance equation of moment.

Then, first, the excavation pressing resistance $f_{rpcHi}$ and the traverse friction resistance $f_{rpfHi}$ in each pattern in the depth direction are obtained.

The $f_{rpcHi}$ means a ground average reaction, which is obtained by multiplying face pressure necessary for penetrating an excavation bit per pattern in the pressing direction by area in the pressing direction. The $f_{rpcHi}$ increases as the cut depth tpx shown in the Equation (1) increases. Further, the $f_{rpfHi}$ is a friction resistance force at the time of the traverse of the cutter post per unit depth.

Next, moments $m_{rpcHi}$ and $m_{rpfHi}$ with the traverse upper cylinder 15 position as a fulcrum are computed. The depth at the central position of a pattern is Hi [m].

$$m_{rpcHi}=(Hi+(L_A+L_B)/1000)frpcHi \quad \text{Equation (4)}$$

$$m_{rpfHi}=(Hi+(L_A+L_B)/1000)frpfHi \quad \text{Equation (5)}$$

Next, the moments $m_{rpcHi}$ and $m_{rpfHi}$ in each pattern are accumulated and computed in the width direction to obtain $S_{mrpcH}$ and $S_{mrpfH}$ as sum of the moments.

$$S_{mrpcH} = \sum_{i=1}^{n_{pd}} m_{rpcHi} \quad \text{Equation (6)}$$

$$S_{mrpfH} = \sum_{i=1}^{n_{pd}} m_{rpfHi} \quad \text{Equation (7)}$$

Let SmrpcH be the whole moment of the excavating resistance force, and SmrpfH be the whole moment of the traverse friction force, then the balance equation of moment is given by:

$$F_{PL} \times L_A = SmrpcH + SmrpfH \quad \text{Equation (8)}$$

When the above Equation (8) is expanded, the following equation is obtained.

$$FpLcH = SmrpcH/L_A \quad \text{Equation (9)}$$

$$FpLcH = SmrpfH/L_B \quad \text{Equation (10)}$$

From the foregoing, the thrust $F_{PL}$ of the traverse lower cylinder 16 can be obtained by the following equation.

$$F_{PL} = (SmrpcH/L_A) + (SmrpfH/L_B) \quad \text{Equation (11)}$$

The comparison unit 26*g* compares the value of the thrust $F_{PL}$ obtained as described above with the rated output of the excavator 10. The rated output (maximum traverse force) of the excavator 10 employed in the present embodiment is 55*t*.

Next, the excavating efficiency evaluation unit 26*h* divides the thrust $F_{PL}$: 26.5 t calculated by the rated output. Accordingly, 26.5/55=0.48.

The evaluation unit 26*h* rearranges the obtained 0.48 (48% of the rated output) in the dimensionless number 48 to display it as the evaluation value on the evaluation value output column C12 of the CRT 26*i*, as shown in FIG. 9. Further, at the same time, the evaluation symbol "◎" is displayed as the excavation right or wrong judgment reference.

The excavation right or wrong judgment reference is represented by four stages: "◎", "○", "Δ" and "x". "◎", "○", "Δ" and "x" are selectively represented in case of maximum estimated traverse force<maximum traverse force of excavator specification, in case of average estimated traverse force<that of excavator specification, in case of minimum estimated traverse force<that of excavator specification, and in case of minimum estimated traverse force>that of excavator specification, respectively.

Figure 10:
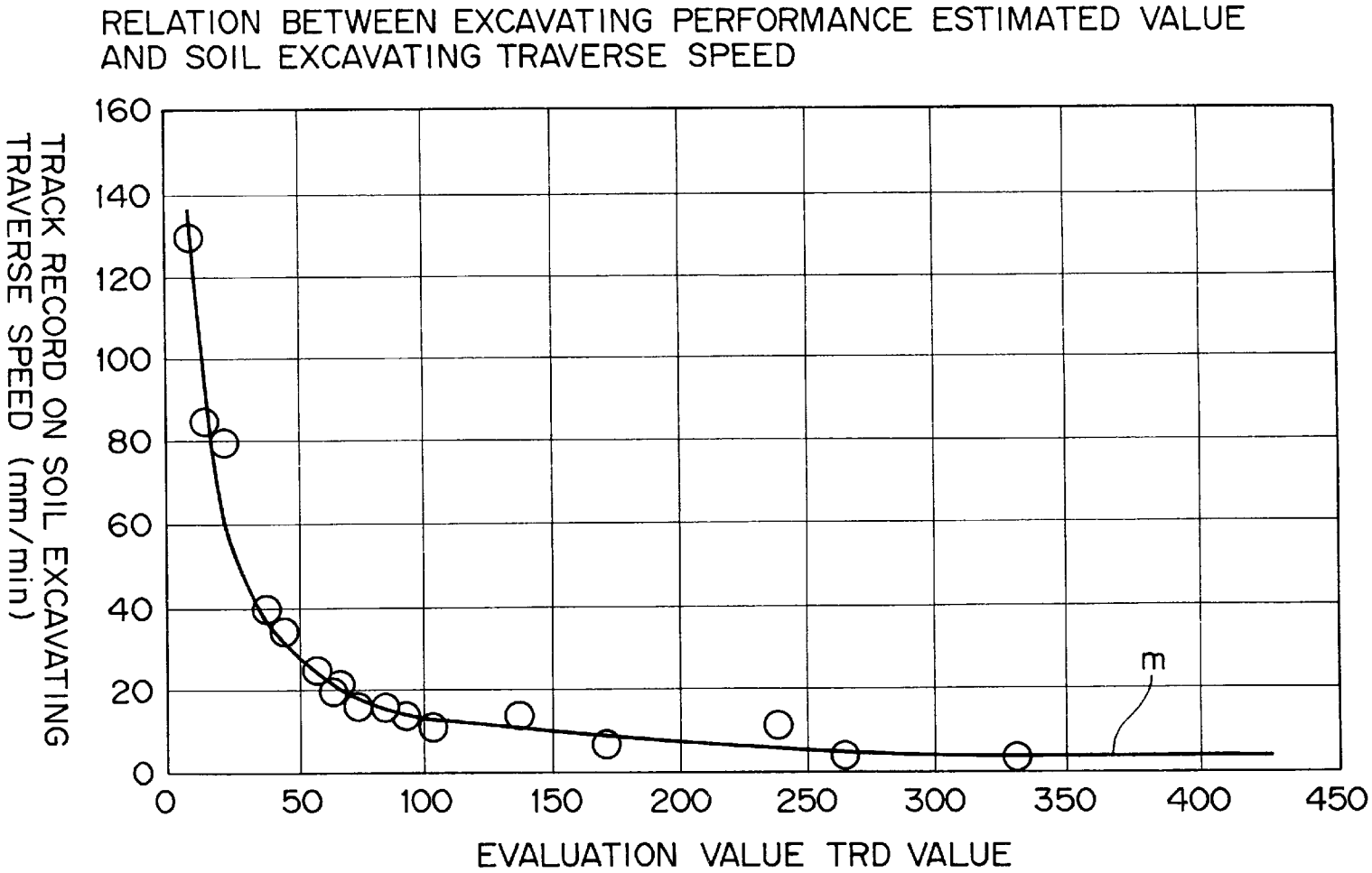
FIG. 10 is a graph showing the relation between the evaluated value and the actual results of excavating traverse speed.

The graph of FIG. 10 takes the evaluation value and the soil excavation traverse force on the axis of abscissa and the axis of ordinates, respectively, to plot the actual results of the soil excavation traverse speeds collected every excavating work site. For example, when the evaluation value is obtained by the computation, if it is obtained from an approximate curve m obtained by plotting the traverse speed actual value corresponding to the evaluation value 48, it is possible to know the traverse speed that can be set in carrying out the excavating work as scheduled.

It is noted as shown in FIG. 3 that the excavation data of the excavating sites are stored sequentially in DB 26*a* of the control server 26 through the network. Because of this, the plot number of the soil excavation traverse speed actual result increases as the construction sites increase. Thereby, the approximate curve m is to represent more accurately the relation between the evaluation value and the excavation traverse speed.

The above-described method for supporting construction of underground continuous wall supports the construction method at the time of excavation. In the following, the method for supporting aging work carried out when daily excavation work is completed. The daily aging work is possible to reduce the friction between the cutter post and the soil in the morning of next day.

The aging supporting method according to the present invention mainly comprises: in the above-described underground continuous wall construction, in connection with the aging work of the cutter post carried out after the daily excavating work is completed, measuring the withdrawal position at which the cutter post is withdrawn from the building end (or the improved end face) and the soil end (or the ground end face), and the mechanical load of the cutter post at the withdrawn position, and comparing the withdrawal distance and the mechanical load as the measured data with the set value preset to thereby judge the right or wrong of the aging work.

In this case, it is possible to judge whether or not the aging work carried out at the time of completion of the excavating work is adequately carried out.

Further, the excavator used for the aging supporting method mainly comprises: in the aging work carried out after the daily excavating work is completed, a measuring unit for measuring, as aging data, the withdrawal distance of the cutter post withdrawn from the building end and the soil end and the mechanical load of the cutter post at the withdrawal position, an aging set-value storage unit for pre-storing the set value as the proper aging conditions, a judging unit for comparing aging data measured by the measuring unit with the aging set value stored in the aging set-value storage unit to thereby judge the right or wrong of the aging work.

In this case, the aging work can be carried out efficiently.

Figure 11:
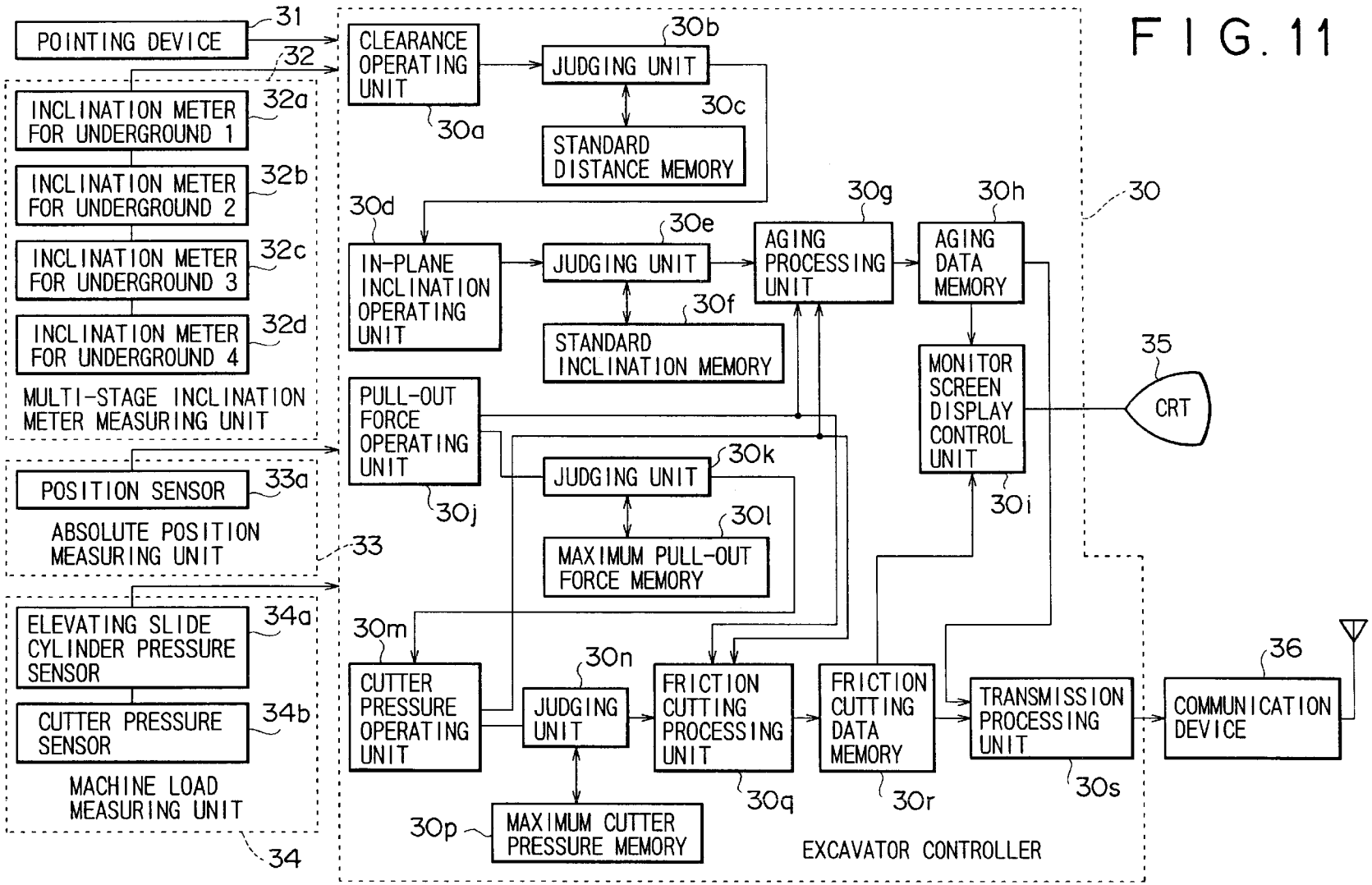
FIG. 11 is a block diagram showing the constitution of a controller mounted on the excavator according to one embodiment of the present invention.

FIG. 11 shows a controller 30 mounted on the excavator 10 and peripheral devices thereof.

On the input side of the controller 30 are connected a pointing device 31, a multi-stage inclination-meter measuring unit 32, an absolute position measuring unit 33, and a machine load measuring unit 32, and on the output side thereof are connected a CRT 35 and a communication device 36.

The pointing device 31 is provided so that various instructions are input in the controller 30 by instructing an icon displayed on the screen of the CRT 35.

The multi-stage inclination-meter measuring unit 32 has four stages of inclination meters 32*a* to 32*d* disposed in the width direction of the cutter post.

The absolute position measuring unit 33 is provided with a position sensor 33*a*, and the soil clearance in case the cutter post is moved away from the soil in the aging work, and the building end clearance in case the cutter post is moved away from the building end of the soil cement wall E are output with signals.

The machine load measuring unit 34 is provided with a cylinder pressure sensor 34*a* for detecting the head-side pressure of an elevating slide cylinder for elevating the cutter post, and a cutter pressure sensor 34*b* for detecting pressure of the cutter, more specifically, working pressure of a hydraulic motor for driving the cutter.

In the controller 30, a clearance distance operating unit 30*a* as a measuring unit receives a signal output from the position sensor 33*a* to operate (measure) the soil clearance when the cutter post is moved away from the soil.

The measured soil clearance is imparted to a judging unit 30*b* to check if it exceeds the standard soil clearance stored in a standard distance memory 30*c* as an aging set value memory. In the present embodiment, the standard clearance is set to 0.50 m.

When judgment is made that the measured soil clearance exceeds the standard soil clearance, the operating unit 30*a* again receives a signal output from the position sensor 33*a* to operate (measure) the building end clearance when the cutter post is moved away from the building end. If the soil clearance does not exceed the standard sol clearance, the step is not to proceed to the next step, checking of the building end clearance.

The judging unit 30*b* checks if the building end clearance exceeds the standard building end clearance stored in the standard distance memory 30*c*. If exceeds, processing of an in-plane inclination operating unit 30*d* as a measuring unit is again started. Conversely, if judgment is made of not exceeding, the step is not to proceed to the next step, similarly to the former.

The in-plane inclination operating unit 30*d* receives signals from underground inclination meters 32*a* to 32*d* of the multi-stage inclination meter measuring unit 32 to operate (measure) the in-plane inclination angle of the cutter post.

The operated in-plane inclination angle is imparted to a judging unit 30*e*. Checking is made if lowering than the standard in-plane inclination angle stored in a standard inclination memory 30*f*. In the present embodiment, the in-plane inclination angle is set to 0.2°.

When judgment is made by the judging unit 30*e* that it lowers than the standard in-plane inclination angle, the judging unit 30*e* instructs an aging processing unit 30*g* to start the aging work.

The aging processing unit 30*g* elevates the cutter post repeatedly while rotating the cutter to carry out the aging work.

The cutter post pull-out force and the cutter pressure and the soil clearance, the building end clearance, and the in-plane inclination angle during the aging work are stored in an aging data memory 30*h*. At the same time, they are imparted to a monitor screen display control unit 30*i* and displayed in numeric value on the screen of the CRT 35.

Figure 12:
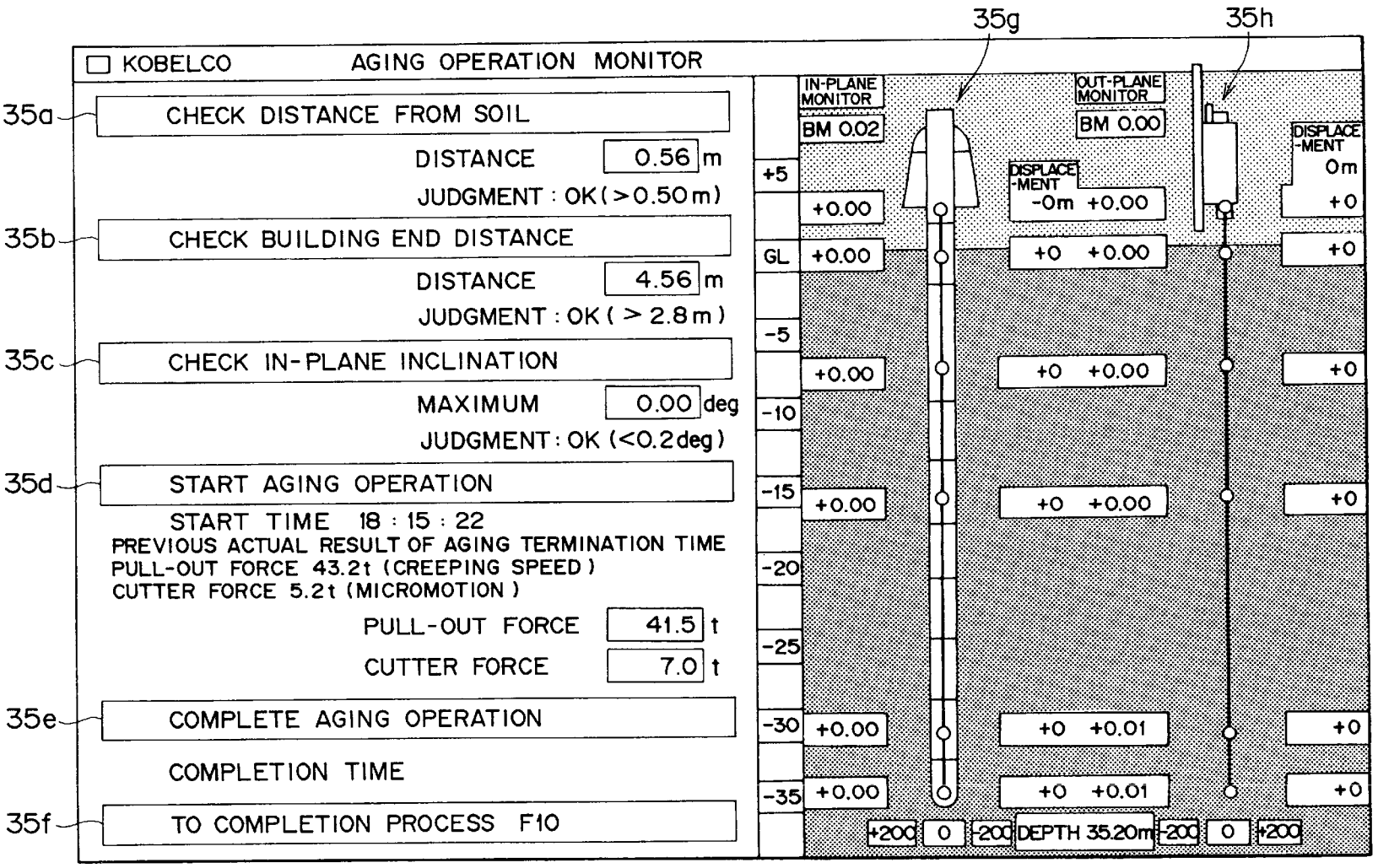
FIG. 12 is a schematic view showing a monitor screen of aging work.

FIG. 12 shows the aging work screen displayed on the CRT 35.

In the figure, on the screen are prepared a button 35*a* for checking the distance from the soil to the cutter post, a button 35*b* for checking the distance from the building end to the cutter post, a button 35*c* for checking the in-plane inclination of the cutter post, an aging start button 35*d*, an aging end button 35*e* and a termination button 35*f*. These buttons can be depressed on the screen by the pointing device 31.

Further, an in-plane monitor image 35*g* of the cutter post, and an out-plane monitor image 35*h* are displayed on the right side of the screen to monitor a displacement amount of each part of the cutter post in the depth direction.

The aging work is carried out in accordance with explanation described in the buttons 35*a* to 35*f* on the screen.

First, when the button 35*a* is depressed, the distance from the soil end is measured and recorded. In this case, because of 0.56 m>0.50 m (standard soil clearance), judgment is made to be OK.

Next, when the button 35*b* is depressed, the distance from the building end is measured and recorded. In this case, because of 4.56 m>2.8 m (standard soil clearance), judgment is made to be OK.

Then, when the button 35*c* is depressed, the in-plane inclination angle is measured and recorded. In this case, because of 0.00 deg<0.2 deg (standard in-plane inclination angle), judgment is made to be OK.

When the above judging results are OK, the aging work can be started. Then, when the button 35*d* is depressed, the aging work starts, and the pull-out force of the cutter post and the cutter pressure are measured and recorded.

The executed aging work is terminated by depression of the button 35*e*, and by depressing the button 35*f*, the process is shifted to the end processing of daily stationary construction.

The steps of the aging work are executed in accordance with the guidance on the screen, and the steps of the aging work are checked every step. For this reason, an operator is able to proceed the aging work positively and safely without depending on the experiences.

In the following, the supporting method of the friction cutting work carried out prior to starting of daily excavating work will be explained.

The friction cutting supporting method according to the present invention mainly comprises, in the aforementioned underground continuous wall construction, in connection with the friction cutting work of the cutter post carried out prior to starting of daily excavating work, measuring the pull-out load of the cutter post and the machine load of the excavator, and comparing the pull-out load and the machine load as measured data with a set value preset to thereby judge the right or wrong of the friction cutting work.

In this case, judgment can be made whether or not the friction cutting work carried out prior to starting of the excavating work is carried out properly.

Further, the excavator used in the friction cutting supporting method mainly comprises, in connection with the friction cutting work of the cutter post carried out prior to starting of daily excavating work, a measuring unit for measuring a pull-out load of the cutter post and a machine load of the excavator, a friction cutting set value storage unit for storing a set value as the proper friction cutting condition, and a judging unit for comparing friction cutting data measured by the measuring unit with the friction cutting set value stored in the friction cutting set value storage unit to judge the right or wrong of the friction cutting work.

In this case, the pull-out force in case the cutter post is pulled out at a fine speed without operating the excavator when the friction cutting work is carried out, and the machine load of the cutter post at the time of pull-out are measured by the measuring unit and imparted to the judging unit. Since constitution is made so that the judging unit compares the values of the measured friction cutting data with the set value stored in the set value storage unit to judge whether or not the friction cutting work is carried out properly, it is possible to carry out the friction cutting work efficiently.

In carrying out the friction cutting work, when the cutter post is elevated at a fine speed, a pull-out operating unit 30*j* as a measuring unit receives a signal output from the elevating slide cylinder pressure sensor 34*a* to operate (measure) the pull-out force of the cutter post.

The operated pull-out force is imparted to a judging unit 30*k* to judge whether or not it arrives at the maximum pull-out force stored in a maximum pull-out memory 30*l*. That is, if the working pressure detected by the pressure sensor 34*a* is not more than the maximum pull-out force, judgment is made that the cutter post is operated in the normal state. On the other hand, in case of arriving at the maximum pull-out force, judgment is made that the cutter post is not finely operated. In case the cutter post is not operated, the step is not to proceed to the next step.

When judgment is made that the cutter post is operated, the cutter is rotated at a fine speed, and processing of a cutter pressure operating unit 30*m* as the measuring unit is started.

The operating unit 30*m* operates (measures) cutter pressure output from the cutter pressure sensor 34*b*.

The operated cutter pressure is imparted to a judging unit 30*n* to judge whether or not it arrives at the maximum cutter pressure stored in a maximum cutter pressure memory 30*p*. That is, if the cutter pressure detected by the pressure sensor 34*b* is not more than the maximum cutter pressure, it is regarded that the cutter is operated in the normal state.

When rotation of the cutter is confirmed, the judging unit 30*n* instructs a friction cutting processing unit $^{30}q$ to start friction cutting work.

The processing unit 30*q* causes the cutter post to fine-operate and to drive the cutter to thereby carry out the friction cutting work. The cutter post pull-out force and the cutter pressure and the work time at the time of friction cutting are stored in a friction cutting data memory 30*r* and imparted to the monitor screen display control unit 30*i* and displayed in numerical value on the screen of the CRT 35.

Figure 13:
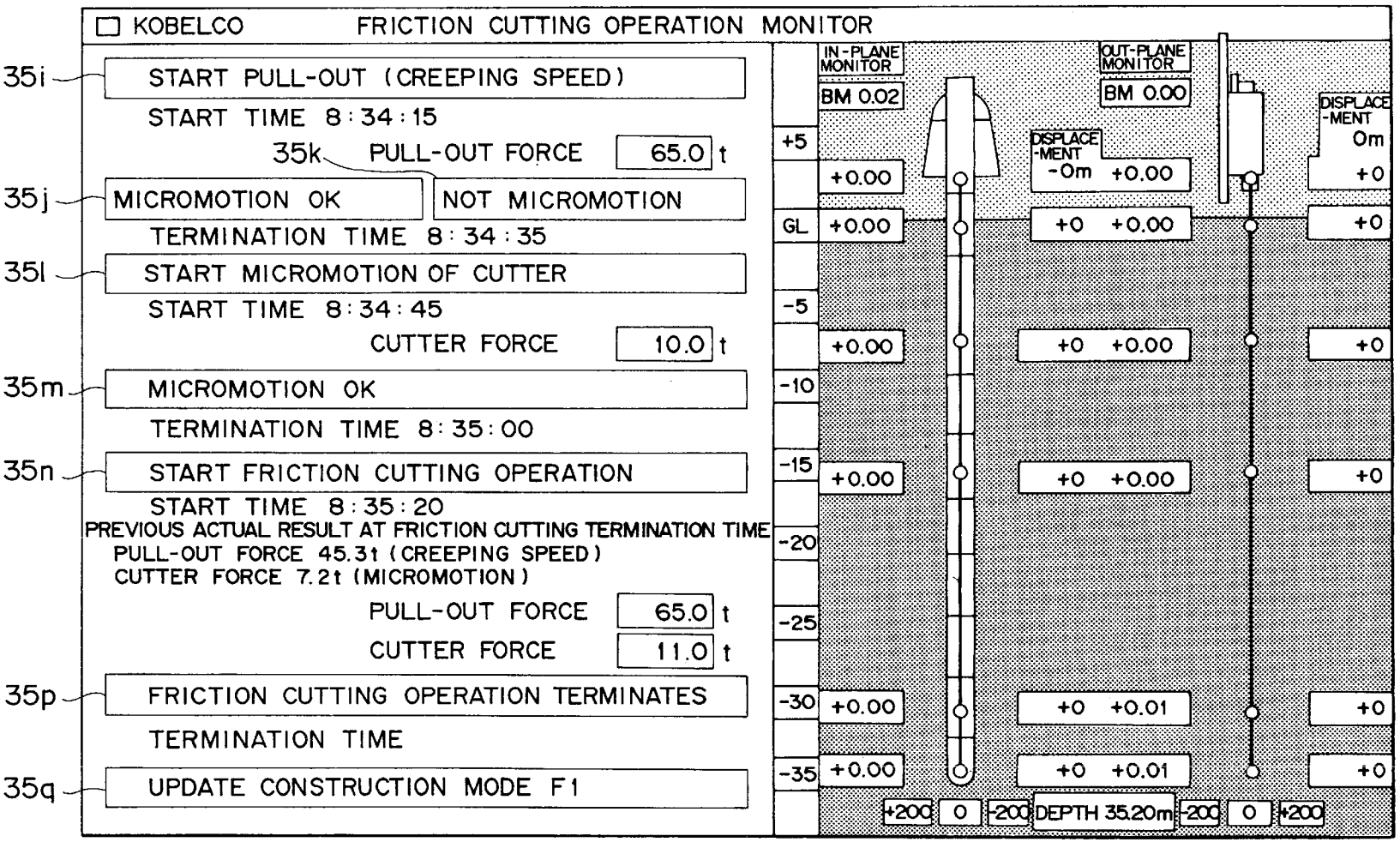
FIG. 13 is a schematic view showing a monitor screen of friction cutting work.

FIG. 13 shows the friction cutting work screen displayed on the CRT 35.

In the figure, on the screen are provided a button 35*i* for carrying out the pull-out by the fine moving (or creeping speed), a fine moving (or micromotion) OK button 35*j*, a not-fine moving button 35*k*, a cutter fine moving start button 35*l*, a fine moving OK button 35*m*, a friction cutting work start button 35*n*, a friction cutting work termination button 35*p*, and a construction mode change button 35*q*.

On the right side of the screen, the displacement amount of the cutter post is monitored similarly to FIG. 12.

The friction cutting work is carried out in accordance with explanation described in the buttons on the screen.

First, when the button 35*i* is depressed, the cutter post is elevated at a fine speed in the state that the cutter is not rotated, and the pull-out start time is recorded. In this case, because of the pull-out force 65 t<70 t (maximum pull-out force), the fine moving OK button 35*j* can be depressed.

In case of not fine moving, the not fine moving button 35*k* is depressed whereby after recording the maximum pull-out force, next cutter rotating work enters.

When the fine moving button 35*j* is depressed, the pull-out termination time is recorded, and the cutter fine operation start button 35*l* can be depressed. When the cutter fine moving start button 35*l* is depressed, the cutter pressure is measured. In this case, because of the cutter pressure 10 t<24 t (maximum cutter pressure), the fine moving OK button 35*m* can be depressed. At this time, the cutter fine moving termination time is recorded.

Even in case, generally, no fine moving occurs in the initial elevating operation, the earth and sand are stirred by rotation of the cutter, and the adhesive force is reduced to enable elevating operation.

Next, the fine moving OK button 35*m* is depressed whereby the button 35*n* can be depressed. When the button 35*l* is depressed, the friction cutting work is started.

In the friction cutting work, the elevating operation of the cutter post is executed repeatedly while alternately inverting the round direction of the cutter. The pull-out force of the cutter post and the cutter pressure at that time are measured, and data are stored in the friction cutting memory 30*r*.

The friction cutting work is terminated by pressing down the button 35*p*. When the button 35*q* is depressed, the mode can be shifted to the next construction mode.

Data collected at the time of the aging work and the friction cutting work and stored in the aging data memory 30*h* and the friction cutting data memory 30*r* are transmitted to the control server through the transmission processing unit 30*s* and the communication device 36.

Figure 14:
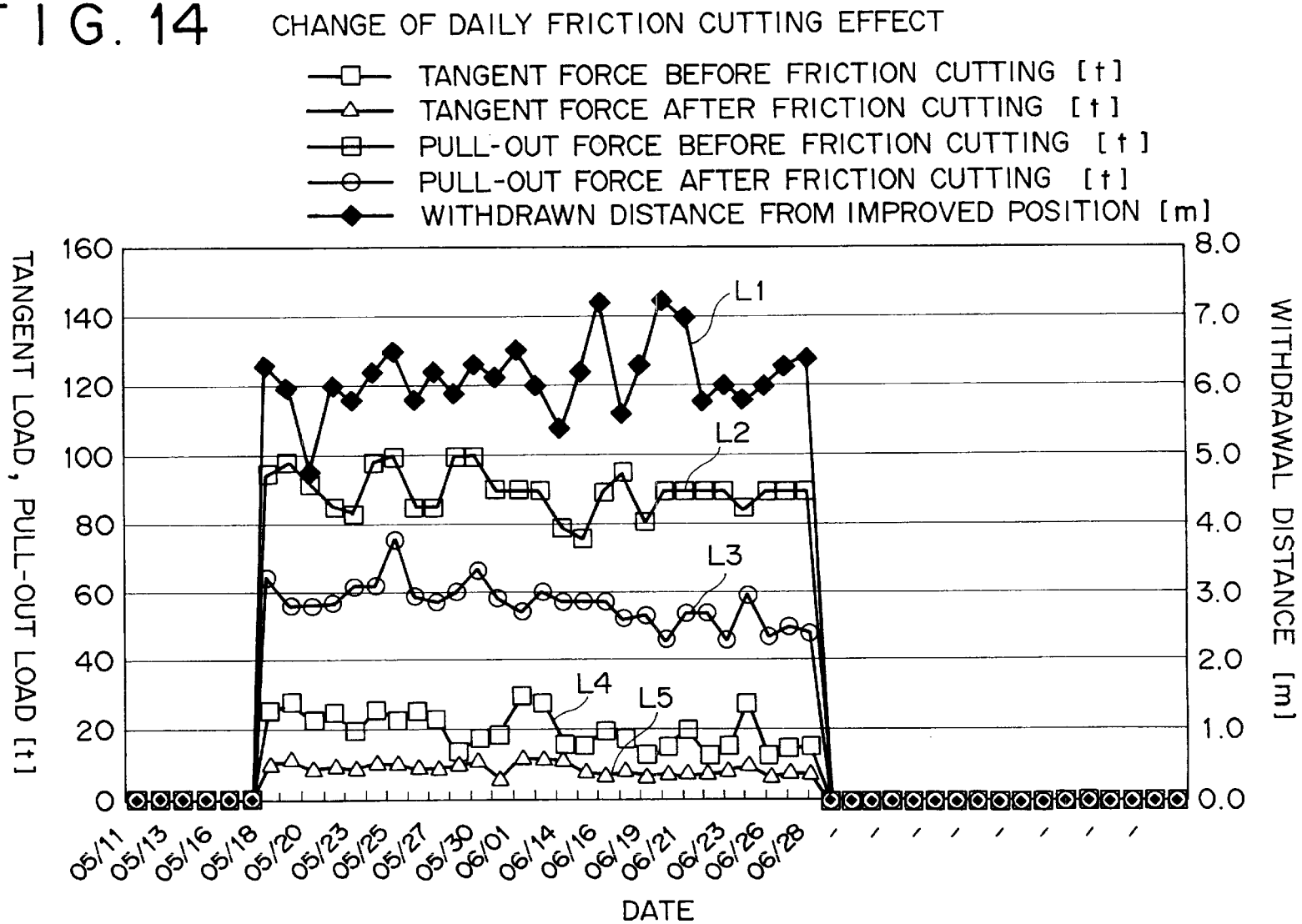
FIG. 14 is a graph showing a change of the friction cutting work.
Figure 15A:
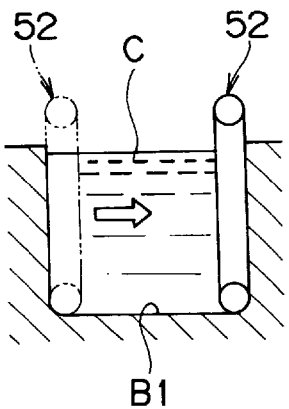
PRIOR ART FIG. 15a
FIGS. 15*a* to 15*d* are views of steps for explaining the conventional method of excavating construction.
Figure 15B:
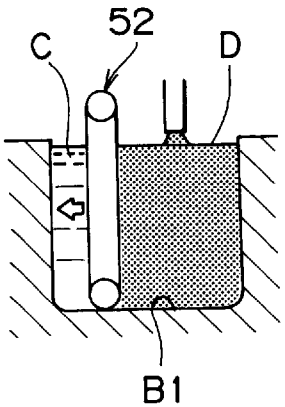
Figure 15C:
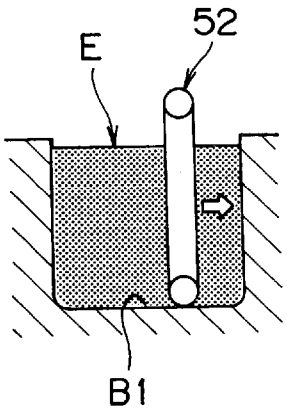
Figure 15D:
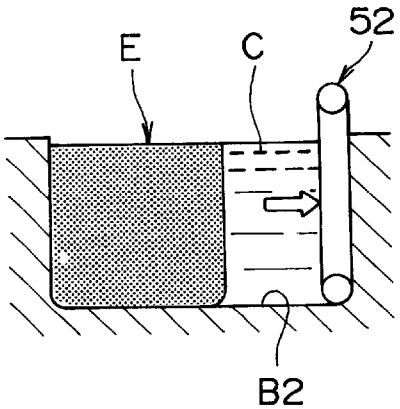

Further, a change of the aging work and the friction cutting work can be also displayed on the screen of the CRT 35. Explanation will be made taking the friction cutting work as an example. As shown in FIG. 14, the withdrawal distance from the daily collected building end is displayed as a graph L1.

The pull-out force before friction cutting and the pull-out force after friction cutting are displayed as a graph L2 and a graph L3, respectively.

The tangent force before friction cutting and the tangent force after friction cutting are displayed as a graph L4 and a graph L5, respectively.

If a change of the friction cutting work is displayed by the graphs, for example, in case the friction cutting effect is high, it is possible to finish the friction cutting work early to enhance the construction efficiency such as shifting to the excavating work.

Likewise, it is suitable that the thus measured data are stored in time sequence, and a change of the aging work is output by the graphs.

In this case, since a change of the aging work is output in graph, the effect of the aging work can be grasped.

Further, it is preferable in the database that data measured after completion of daily excavating work, more specifically, the withdrawal distance of the cutter post withdrawn from the building end and the soil end, and the machine load applied to the cutter post when the cutter post is elevated are received from the excavator through the network and accumulated.

It is further preferable that data measured in the friction cutting work carried out prior to starting of the excavating work, more specifically, the pull-out load of the cutter post and the machine load of the excavator are received from the excavator through the network and accumulated.

Since constitution is made so that at least either of the aging data or the friction cutting data is accumulated in the database, it is possible to provide data of the aging work and data of the friction cutting work for the excavators in the fields.

From the foregoing, one embodiment of the present invention has been disclosed, but the scope of protection of the present invention is not limited thereto.

I claim:

1. A method for supporting construction of an underground continuous wall, comprising the steps of:

in a method for constructing an underground continuous wall in which a cutter post provided with an excavating member is inserted into the ground, and the cutter post is moved in a lateral direction while operating said excavating member to thereby form an excavated trench, obtaining intensity distribution of ground strength of the ground to be excavated in a depth direction;

obtaining necessary excavating ability of said cutter post balanced with an excavating resistant force obtained from accumulated ground strength on the basis of the distribution; and comparing said necessary excavating ability obtained with excavating ability of an excavator used in a work site to evaluate excavating efficiency on the basis of a compared result.

2. The method according to claim 1, wherein ground strength in each depth of said ground strength is converted from soil property obtained by a geological survey by way of drilling survey and a test result obtained by a standard penetration test.

3. The method according to claim 1, wherein said excavating ability of said excavator is expressed by maximum thrust of a traverse cylinder provided on said cutter post.

4. A method for supporting construction of an underground continuous wall, comprising the steps of:

in an aging operation of a cutter post when an underground continuous wall is constructed by inserting a cutter post provided with an excavating member into the ground, and moving the cutter post in a lateral direction while operating said excavating member to thereby form an excavated trench, measuring a withdrawal distance of said cutter post withdrawn from an improved end face and a ground end face and a machine load of said cutter post at a withdrawn position; and comparing said withdrawn distance and said machine load as measuring data with a set value preset to thereby evaluate adequacy of the aging operation.

5. A method for supporting construction of an underground continuous wall, comprising the steps of:

in a friction cutting operation of a cutter post when an underground continuous wall is constructed by inserting a cutter post provided with an excavating member into the ground, and moving the cutter post in a lateral direction while operating said excavating member to thereby form an excavated trench, measuring a pull-out load and a machine load of said cutter post; and comparing said pull-out load and said machine load as measuring data with a set value preset to thereby evaluate adequacy of said friction cutting operation.

6. The method according to claim 4, wherein the adequacy of said aging operation is judged at every step carried out in said aging operation.

7. The method according to claim 5, wherein the adequacy of said friction cutting operation is judged at every step carried out in said friction cutting operation.

8. The method according to claim 4, wherein said measuring data are stored in a form of time-series data, and a change of said aging operation is output by a graph.

9. The method according to claim 5, wherein said measuring data are stored in a form of time-series data, and a change of said friction cutting operation is output by a graph.

10. An excavator for supporting construction of an underground continuous wall, comprising:

a cutter post provided with an excavating member inserted into the ground to be excavated;

a measuring unit for measuring, as aging data, a withdrawal distance of said cutter post withdrawn from an improved end face and a ground end face, and a machine load of said cutter post at a withdrawn position;

an aging set value storage unit for pre-storing a set value as proper aging condition; and a judging unit for judging adequacy of said aging operation by comparing said aging data measured by said measuring unit with said set value stored in said aging set value storage unit.

11. An excavator for supporting construction of an underground continuous wall, comprising:

a cutter post provided with an excavating member inserted into the ground to be excavated;

a measuring unit for measuring a pull-out load of the cutter post and a machine load of the excavating member in a friction cutting operation of said cutter post;

a friction cutting set value storage unit for storing a set value as proper friction cutting condition; and a judging unit for judging adequacy of said friction cutting operation by comparing friction cutting data measured by said measuring unit with said set value stored in said friction cutting set value storage unit.

12. A system for supporting construction of an underground continuous wall, comprising:

an excavator for construction of an underground continuous wall having a cutter post provided with an excavating member and moving the cutter post in a lateral direction while operating said excavating member; and a control computer connected to said excavator through a network, said control computer comprising:

a ground strength evaluating unit for obtaining ground strength distribution of the ground to be excavated in a depth direction on the basis of imparted ground property;

a necessary excavating ability operating unit for obtaining accumulated ground strength from said ground strength distribution, and obtaining necessary excavating ability of said cutter post balanced with excavation resistant force obtained from said accumulated ground strength;

a comparing unit for comparing said necessary excavating ability obtained with excavating ability of the excavator carried into a work site;

an excavating efficiency evaluating unit for evaluating excavating efficiency on the basis of compared result of said comparing unit; and a transmit-receive unit for receiving a request from said excavator and transmitting evaluated result of excavating efficiency by said excavating efficiency evaluating unit to the excavator.

13. The system according to claim 12, said excavator comprising:

a measuring unit for measuring, as aging data, a withdrawal distance of said cutter post withdrawn from an improved end face and a ground end face and a machine load of said cutter post at a withdrawn position in an aging operation of said cutter post;

an aging set value storage unit for pre-storing a set value as proper aging condition; and a judging unit for comparing said aging data measured by said measuring unit with said set value stored in said aging set value storage unit to thereby judge adequacy of said aging operation.

14. The system according to claim 12, said excavator comprising:

a measuring unit for measuring a pull-out load of said cutter post and a machine load of the excavating member in a friction cutting operation of said cutter post;

a friction cutting set value storage unit for storing a set value as proper friction cutting condition; and a judging unit for comparing friction cutting data measured by said measuring unit with said set value stored in said friction cutting set value storage unit to thereby judge adequacy of said friction cutting operation.

15. The system according to claim 12, said control computer further comprising a database for storing information tested in each work site, said control computer receiving a request from said excavator to transmit necessary information.

16. The system according to claim 15, wherein said database stores at least one of data measured in an aging operation carried out after an excavating operation has been completed and data measured in a friction cutting operation carried out when the excavating operation starts.

* * * * *